United States Patent [19]

Walker

[11] 4,168,558

[45] Sep. 25, 1979

[54] MOUNT FOR WHEELED SUITCASES

[76] Inventor: Brooks Walker, 1280 Columbus Ave., San Francisco, Calif. 94133

[21] Appl. No.: 885,744

[22] Filed: Mar. 13, 1978

[51] Int. Cl.[2] ..... B60B 33/00

[52] U.S. Cl. ..... 16/18 CG; 16/38

[58] Field of Search ..... 16/45, 18 CG, 31 R, 16/31 A, 38, 39, 40; 190/18 A, 41 R

[56] References Cited

U.S. PATENT DOCUMENTS

| | | | |
|---|---|---|---|
| 2,170,257 | 8/1939 | Andersen | 16/31 R |
| 2,981,969 | 5/1961 | Fontana | 16/18 CG |
| 3,345,675 | 10/1967 | Haydock | 16/45 |
| 3,987,875 | 10/1976 | Szabo | 190/18 A |

*Primary Examiner*—George H. Krizmanich
*Attorney, Agent, or Firm*—Gordon Wood

[57] ABSTRACT

A wheel mount adapted to be used on the bottom side of a suitcase to permit wheeling the latter. The mount is formed so as to minimize the likelihood of damage to the mount and to the wheel which it supports. The mount is elongated in a longitudinal direction and its sidewalls are slantingly disposed relative to the wheel in order to minimize damage when struck by another object. One form of the invention is made from a block of plastic or the like and other forms are made of formed sheet metal.

8 Claims, 10 Drawing Figures

Fig 1
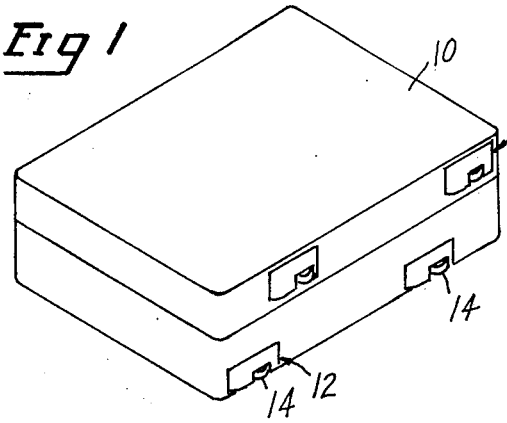
Fig. 2
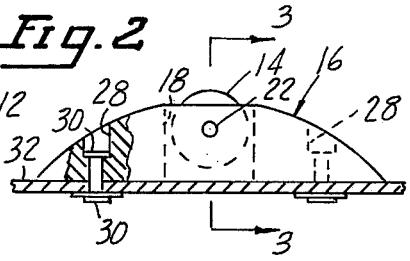
Fig. 3.
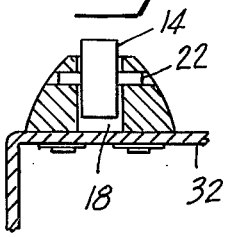
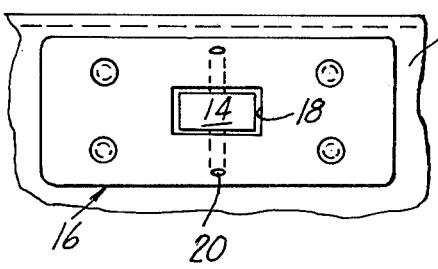
Fig. 4.
Fig. 5
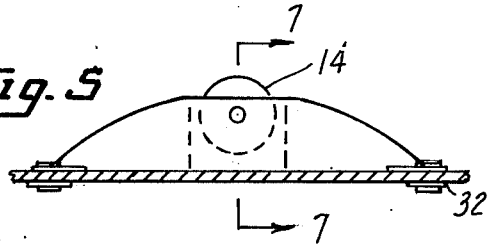
Fig. 6
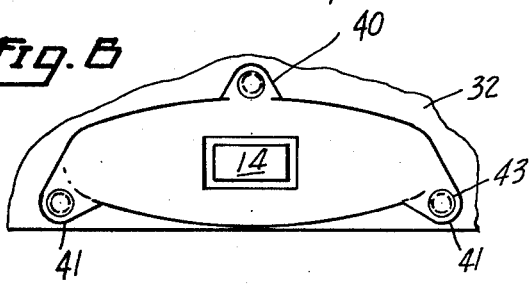
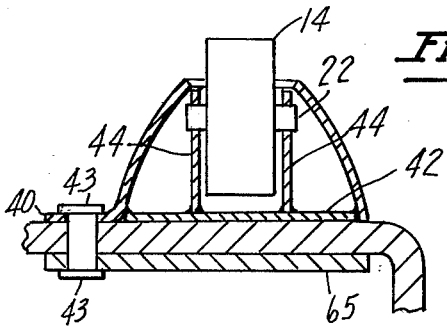
Fig. 7.
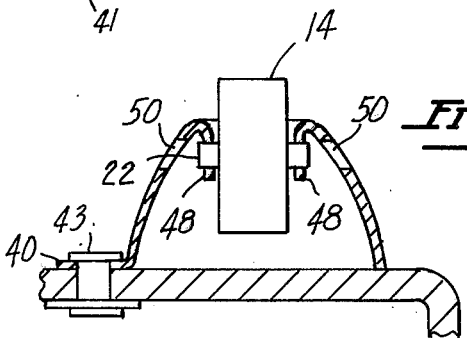
Fig. 8.
Fig. 9
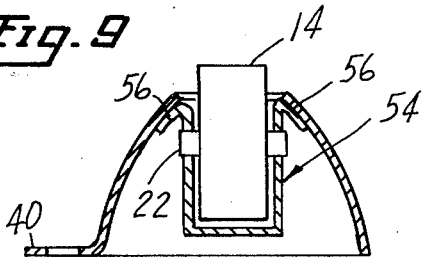
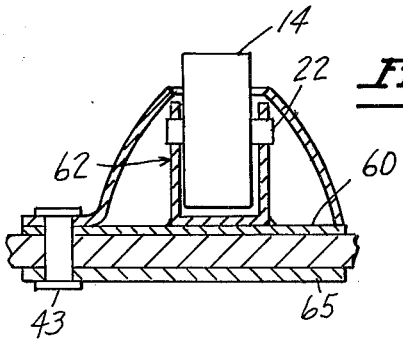
Fig. 10.

MOUNT FOR WHEELED SUITCASES

This invention relates to wheeled suitcases and the like and is particularly directed to the provision of a wheel mount adapted to be applied to the lower side of a suitcase or like article. Heretofore various types of mounts have been provided for rotatably supporting ground wheels on which a suitcase may be wheeled. Many such devices are impractical since in transit suitcases are subjected to rough usage not only by personnel, but during movement along the traveling belts and other types of airport conveyors. If the wheel or mount is struck by a stationary obstruction or struck by another suitcase the mount may be torn away from the suitcase or the wheel may become detached from the mount or otherwise damaged so as not to function properly.

The main object of the present invention is the provision of a wheel mounting means for a suitcase which overcomes the disadvantages of prior art devices of like nature.

Another object of the invention is the provision of a wheel mount which is formed so as to minimize damage while the suitcase to which it is attached is in transit or moving from one form of transport to another.

Another object of the invention is the provision of a wheel mount which is relatively inexpensive to make and is formed so as to permit the use of relatively small, unobtrusive wheels and at the same time be capable of being wheeled on any surface including shag rugs, rough concrete and the like.

Other objects and advantages will be apparent from the following specification and from the drawings.

FIG. 1 is an isometric of a suitcase showing four wheel mounts attached to the bottom side thereof.

FIG. 2 is a side elevation of one form of wheel mount.

FIG. 3 is a vertical transverse section through the central portion of the wheel mount showing the wheel in elevation.

FIG. 4 is a plan view of the wheel mount of FIG. 2.

FIG. 5 is a side elevation of another form of wheel mount.

FIG. 6 is a plan view of the wheel mount of FIG. 5.

FIG. 7 is an enlarged central cross sectional view of the wheel mount of FIG. 5.

FIGS. 8-10 are central cross sectional views showing modified forms of the wheel mount of FIGS. 5, 6.

The invention is adapted to be used with a conventional suitcase generally designated 10 in FIG. 1. Secured to the bottom side of said suitcase 10 in a manner to be described are four wheel mounts generally designated 12 with each rotatably supporting a ground wheel 14. One form of wheel mount is shown in FIGS. 2—4 wherein the mount may be formed conveniently from a block of plastic in order to provide a main body portion 16 formed with a central vertically extending generally rectangular slot 18 between opposite sides thereof for receiving therein the wheel 14. The body 16 is formed with a horizontally extending hole 20 for receiving therein the pin 22 on which the wheel 14 is rotatably supported. Pin 22 may be secured relative to body 16 by press fitting or other suitable means. The body is also formed with preferably four countersunk holes 28 for receiving rivets 30 which are passed through suitable openings in the bottom 32 of the suitcase for fixedly securing the mount to the suitcase.

It will be apparent from FIG. 2 and FIG. 3 that the side-walls of the mount are formed so that the same diverge from the wheel opening 18 is both longitudinal and transverse directions. By this structure the likelihood of injury to the mount or wheel is substantially eliminated by reducing or eliminating the chance of the mount catching on an obstruction.

Another form of the invention is shown in FIGS. 5-7. In this case the sidewalls of the body portion of the mount are formed of sheet metal which is bent so that said sidewalls diverge both in the longitudinal direction and also the transverse direction. From the sheet metal forming the body preferably three or more securing lugs 41, 42 are formed and said lugs are apertured for receiving the securing means such as rivets 43. As best seen in FIG. 7 a base plate 42 is welded to the body portion and a pair of vertically extending lugs 44 integrally secured to said base plate are apertured to receive pin 22 therethrough for rotatably supporting the wheel 14. Pin 22 may be secured by press fitting it in lugs 44 or upsetting its ends.

A modification of the structure shown in FIGS. 5, 6 is illustrated in FIG. 8 wherein vertically extending lugs 48 are struck from the sheet metal of the body portion for receiving the wheel support pin 22. In order to obtain access to pin 22 holes 50 may be formed in the sidewalls of the mount.

Still another form of the invention is shown in FIG. 9 wherein a U-shaped sheet metal member generally designated 54 is formed with a pair of flanges 56 which are adapted to be spot welded to the sidewalls of the body. By this structure the main body portion and the wheel mounting member 54 may be made separately with the spot welding operation being the last step in manufacture. The pin 22 can be inserted with the wheel before spot welding the wheel support to the body.

Still another form of the invention is shown in FIG. 10 wherein a separate base plate 60 has fixedly secured thereto the cross piece of a generally U-shaped wheel support member 62 for receiving the wheel and its pin. In this case both the base plate 60 and the body portion of the mount may be fixedly secured by the rivets used to attach it to the suitcase.

In all forms of the invention the mounts are staggered longitudinally of the suitcase in the manner seen in FIG. 1 so that there is no interference between mounts when the suitcase is open.

Not only does the above described invention minimize damage to the mounts and wheels, but it also permits the use of relatively small wheels and at the same time enables the suitcase to be wheeled over rough surfaces such as shag rugs, concrete and asphalt.

In order to strengthen the connection between the mount and the suitcase a plate 65 may be applied to the interior face of the suitcase and suitably apertured to receive rivets 43 therethrough as indicated in FIGS. 7 and 10.

Two or more suitcase may be secured together by suitable post center attachments so as to be wheeled together without an added handle as is done, for example, by sample salesmen.

In the form of the invention shown in FIGS. 2-4 the weight of the body portion may be reduced if desired by forming said portion with recesses.

In the forms of the invention shown in FIGS. 5-10 the securement together of the various parts may of course be achieved by modern plastics.

I claim:

1. A mounting for supporting a suitcase or like article comprising:

a housing, a base on said housing adapted to be secured to one side of such article, a ground wheel, means on said housing rotatably supporting said ground wheel, said housing being formed with its exterior sides slantingly disposed and diverging in all directions from said wheel toward said base whereby said base is relatively large compared to the lateral extent of said wheel, and whereby an obstruction to movement of said mount tends to strike a glancing blow on said mount to minimize damage to said mount and said wheel.

2. A mount according to claim 1 wherein said exterior sides are formed of sheet metal, lugs struck from said sheet metal at said base for securing said housing to such article.

3. A mount according to claim 1 wherein said housing is elongated in the rolling plane of said wheel with the extent of the base at the lateral sidewalls considerably smaller than the length at the longitudinal sidewalls.

4. A mount according to claim 2 wherein a pair of plates extend between said base and said exterior walls, and wherein said means is a pin extending between said plates for so rotatably supporting said wheel.

5. A mount according to claim 3 wherein said lateral sidewalls are bent inwardly to provide a pair of opposed parallel lugs, a pin extending between said lugs for so rotatably supporting said wheel.

6. A mount according to claim 5 wherein said lateral sidewalls are provided with openings for obtaining access to said pin.

7. A mount according to claim 3 wherein said housing includes a U-shaped wheel support having a pair of legs between which said wheel is rotatably supported, said legs being fixedly secured to said lateral sidewalls at points on opposite sides of said wheel.

8. A mount according to claim 1 wherein said mount consists of a solid body of plastic, an opening in said body receiving said wheel therein, and a pin secured in said plastic for rotatably supporting said wheel.

* * * * *